US005979700A

United States Patent [19]

Suess

[11] Patent Number: 5,979,700

[45] Date of Patent: Nov. 9, 1999

[54] CLIP LIFT FOR TISSUE DISPENSING SYSTEM

[75] Inventor: Kenneth H. Suess, Appleton, Wis.

[73] Assignee: Kimberly-Clark Worldwide, Inc., Neenah, Wis.

[21] Appl. No.: 09/001,064

[22] Filed: Dec. 30, 1997

[51] Int. Cl.[6] ..... B65H 1/08

[52] U.S. Cl. ..... 221/56; 221/52; 312/50

[58] Field of Search ..... 221/52, 56, 58, 221/59, 60, 279; 312/50

[56] References Cited

U.S. PATENT DOCUMENTS

| | | | |
|---|---|---|---|
| 1,209,054 | 12/1916 | Skall | 221/52 |
| 1,593,532 | 7/1926 | Hansen | 221/52 |
| 2,011,403 | 8/1935 | Gessler . | |
| 2,287,420 | 6/1942 | Edmonston . | |
| 2,501,357 | 3/1950 | Speckman et al. . | |
| 2,634,855 | 4/1953 | Mandel . | |
| 2,636,599 | 4/1953 | Willis et al. . | |
| 2,713,454 | 7/1955 | Nute et al. . | |
| 2,802,567 | 8/1957 | Covel . | |
| 2,816,699 | 12/1957 | Nute et al. . | |
| 2,849,152 | 8/1958 | Tuttle . | |
| 2,854,184 | 9/1958 | Heine . | |
| 2,858,045 | 10/1958 | Loeb . | |
| 3,202,316 | 8/1965 | Silver . | |
| 3,224,633 | 12/1965 | Allen . | |
| 3,313,583 | 4/1967 | Turkington et al. | 221/59 |
| 3,425,595 | 2/1969 | Shapira . | |
| 3,459,329 | 8/1969 | Mochizuki et al. . | |
| 3,603,452 | 9/1971 | Singer . | |
| 3,606,082 | 9/1971 | Kuchenbecker . | |
| 3,647,114 | 3/1972 | Bleuer . | |
| 3,942,682 | 3/1976 | McKay . | |
| 4,091,813 | 5/1978 | Shaw et al. | 128/303 |
| 4,185,632 | 1/1980 | Shaw | 128/303.1 |
| 4,219,025 | 8/1980 | Johnson | 128/303.1 |
| 4,231,371 | 11/1980 | Lipp | 128/303.1 |
| 4,231,491 | 11/1980 | Pierson et al. . | |
| 4,232,676 | 11/1980 | Herczog | 128/303.14 |
| 4,248,231 | 2/1981 | Herczog et al. | 128/303.14 |
| 4,586,631 | 5/1986 | Loder . | |
| 4,616,767 | 10/1986 | Seido . | |
| 4,674,498 | 6/1987 | Stasz | 128/303.14 |
| 4,785,807 | 11/1988 | Blanch | 128/303.14 |
| 4,802,476 | 2/1989 | Noerenberg et al. | 128/303.14 |
| 4,850,353 | 7/1989 | Stasz et al. | 128/303.14 |
| 4,862,890 | 9/1989 | Stasz et al. | 128/303.14 |
| 4,922,903 | 5/1990 | Welch et al. | 606/37 |
| 4,927,420 | 5/1990 | Newkirk et al. | 606/45 |
| 4,958,539 | 9/1990 | Stasz et al. | 76/104.1 |
| 4,980,021 | 12/1990 | Kitamura et al. | 156/643 |
| 5,071,419 | 12/1991 | Rydell et al. | 606/48 |
| 5,217,458 | 6/1993 | Parins | 606/48 |
| 5,342,381 | 8/1994 | Tidemand | 606/174 |
| 5,363,985 | 11/1994 | Cornell | 221/56 |
| 5,395,369 | 3/1995 | McBrayer et al. | 606/51 |
| 5,396,900 | 3/1995 | Slater et al. | 128/751 |
| 5,697,926 | 12/1997 | Weaver | 606/41 |

FOREIGN PATENT DOCUMENTS 061589 10/1982 European Pat. Off. .

*Primary Examiner*—William E. Terrell
*Assistant Examiner*—Joe Dillon, Jr.
*Attorney, Agent, or Firm*—Brinks Hofer Gilson & Lione

[57] ABSTRACT

This invention relates to a facial tissue dispensing system which includes a clip lift member. The clip lift member of the present invention is positioned beneath the stack of facial tissues placed in the carton. The clip lift comprises a bendable sheet of material and one or more elastic members. The elastic members are attached to the bottom of the bendable sheet and cause the bendable sheet to buckle in an upward direction in its middle section to push the tissues in an upward direction as the tissues are being dispensed.

9 Claims, 2 Drawing Sheets

CLIP LIFT FOR TISSUE DISPENSING SYSTEM

BACKGROUND OF THE INVENTION

This invention relates to a facial tissue dispensing system, and more particularly, to a clip lift for such a system which lifts the tissues up towards the opening through which the tissues are dispensed as the tissues are being dispensed.

Facial tissues are well known in the art. The uses of facial tissues include, but are not limited to, blowing one's nose, cleaning one's glasses and cleaning. Generally, a facial tissue dispensing system includes a stack of facial tissues placed within a facial tissue carton. A stack of facial tissues ready to be put into a carton is known in the field as a clip. There are two basic types of facial tissue cartons: the pop-up variety and the reach-in variety.

A pop-up carton is generally a square or rectangular carton with a tissue dispensing opening on its top wall. The facial tissues are generally interfolded with each other in pop-up cartons, which is well known in the art. Interfolding means that each facial tissues is folded around part of the tissue immediately beneath the first tissue. There are various types of interfolding, such as Z-folding or V-folding the tissues. Because of the interfolding of the tissues, when a first tissue is pulled up through the tissue dispensing opening, a leading section of a second tissue, i.e., the tissue immediately beneath the first tissue, is also pulled part way through the opening.

In addition, a pop-up carton may include a piece of clear plastic film which covers the tissue dispensing opening. The film is slit such that tissues are dispensed from the carton through the slit. Because the slit is small, tissues are constricted from falling back through the slit once they have been pulled part way through the slit. If there is no such film covering the tissue dispensing opening, generally at one point of the opening, the opening is narrow enough to constrict the tissues.

Thus, as a result of interfolding the tissues and constricting the tissues by the slit, tissues are dispensed from a pop-up carton in the following manner. For the first tissue, the user must reach through the slit to grab the tissue to begin the tissue dispensing process. As the first tissue is being dispensed, because the tissues are interfolded, the leading section of the second tissue is pulled through the slit. Again, because of the slit, the leading section of the second tissue is constricted and will preferably not fall back through the slit into the carton. The leading section of the second tissue preferably remains outside of the carton, while the trailing section of the second tissue remains inside of the carton, interfolded with a third tissue. Then, when the second tissue is dispensed from, i.e., pulled out of, the carton, the leading section of a third tissue is pulled part way through the opening and is then constricted by the slit from falling back into the carton. Thus, the leading section of the third tissue remains outside of the carton for the next use. This process continues until all tissues have been dispensed from the carton.

A reach-in carton is also basically a square or rectangular carton which has a tissue dispensing opening on its top wall which extends down to include a large part of a side wall of the carton. For a reach-in carton, the tissues are generally not interfolded. To dispense tissues, the opening on the side wall of the carton is large enough such that a person simply reaches into the carton to pull out one or more tissues.

There are fall back problems associated with pop-up cartons. For instance, a tissue may not be interfolded with the tissue below it, i.e., there may be missed interfolds between two successive tissues. If this occurs, when the first tissue is dispensed, the second tissue will not rise up with the first tissue through the tissue dispensing slit in the film. Thus, there will be no tissue for a person to grab from above the carton. When this occurs, the person has to reach through the slit of the film covering the tissue dispensing opening and grab the second tissue and basically restart the pop-up tissue process. The film, however, may be distorted and stretched when a person reaches through it to grab a tissue from inside the carton. A distorted and stretched film may result in more fall backs of tissues.

Fall back of tissues may be more prevalent in a deeper carton where there is more distance between the tissue and the top wall dispensing opening or slit. The second tissue may separate from the first tissue as the space between the top of the tissue stack and the top wall dispensing slit progressively increases as the height of the tissue stack decreases. Thus, the second tissue may at first rise up with the first tissue but may then separate from the first tissue before it is pulled through the tissue dispensing slit. Again, then, a user would have to reach through the tissue dispensing slit, distorting and stretching the film covering the tissue dispensing opening, to restart the pop-up tissue process.

Accordingly, it would be desirable to provide a tissue dispensing system that eliminates or decreases the fall back problems associated with pop-up cartons.

SUMMARY OF THE INVENTION

The present invention is directed to a facial tissue dispensing system, and more particularly, to a tissue carton which includes a clip lift for lifting the facial tissues in a vertical direction as the tissues are dispensed from the carton. With the present invention, tissues are always presented right at tissue dispensing opening of the carton.

The facial tissue dispensing system of the present invention is generally a square or rectangular carton which includes an opening for dispensing facial tissues. The opening may be located in the top wall only, in the top wall and a side wall or in the top wall and one or more side walls. The tissue dispensing opening may be covered by a plastic film covering, which has a slit formed therein, wherein tissues are dispensed in a pop-up manner through the slit. The slit is small enough that tissues are constricted from falling back through the slit after they have been pulled through the slit. If there is no such plastic film covering, then at one point, the tissue dispensing opening is narrow enough to constrict the tissues.

With the present invention, the tissues may be interfolded in a stack in the carton. There are a variety of ways of interfolding tissues, such as a Z-fold or a V-fold, which are well known in the art. Because of the interfolding, once a first tissue is pulled up through the tissue dispensing opening or the tissue dispensing slit in the plastic film, a leading section of the tissue immediately beneath the first tissue, i.e., a second tissue, is pulled part way through the opening. Because of the slit, once the leading section of the second tissue has been pulled through the slit, this tissue is constricted and will preferably not fall back through the opening. Thus, the leading section of the second tissue will remain outside of the carton, while the trailing section of the second tissue will remain inside of the carton, interfolded with a third tissue.

The clip lift of the present invention is positioned beneath the stack of facial tissues in the carton and on top of the bottom wall of the carton. The clip lift is a bendable or foldable sheet of material which has dimensions smaller than the carton. The clip lift is designed to lift the facial tissues upward as the tissues are being dispensed from the carton. One or more elastic pieces of material are attached to the bottom of the sheet. The elastic members are attached under tension at one end of the sheet and at the end opposite to the first end.

When the carton is full with tissues, the weight of the tissues on the bendable sheet holds the sheet in a flat position. Once tissues begin to be dispensed from the carton and the weight of the tissues on the bendable sheet diminishes, the sheet and the elastic member may begin to move. Because the elastic member is under tension, the elastic member will relax once it may begin to move. Thus, the elastic member will contract in length. This contraction in length causes the bendable sheet to buckle in an upward direction in the middle of the bendable sheet, similar in shape to a bell-shaped curve. This in turn causes the facial tissues also to buckle in an upward direction in their middle towards the top wall, and thus the tissue dispensing opening, of the carton.

The bendable sheet may be made of any number of materials which may support the weight of the tissues and which may be deformed. Thus, the bendable sheet may be made of a material such as paper or cardboard. Cardboard is a good material because it is low in cost and is recyclable. By varying the stiffness of the cardboard material, as well as the number, size and pretension and position of attachment of the elastic members, the lifting force of the sheet on the facial tissues may be optimized. The elastic member may be made of any elastic material, such as, for example, rubber bands.

These and other objects, advantages, and features of the present invention will be better understood upon review of the following detailed description of the preferred embodiments.

DETAILED DESCRIPTION OF THE PREFERRED EMBODIMENTS

Figure 1:
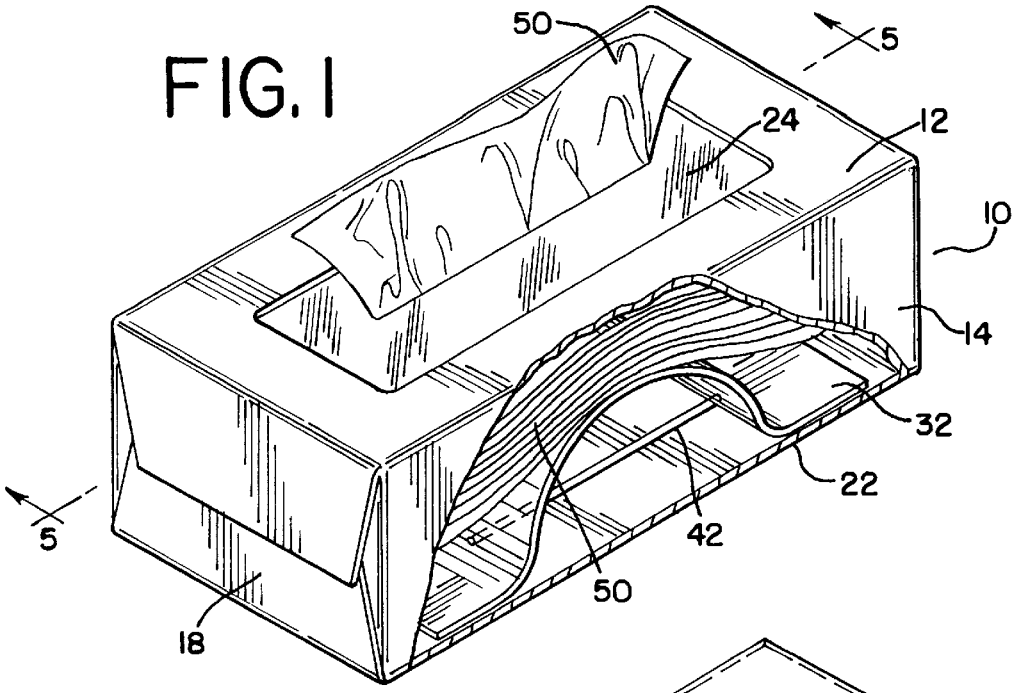
FIG. 1 is a perspective view of a facial tissue dispensing system.

FIG. 1 illustrates a perspective view of the facial tissue dispensing system. Generally, the facial tissue dispensing system includes a rectangular carton 10, with a top wall 12, two side walls 14, 16, two end walls 18, 20 and a bottom wall 22. The top wall 12 is provided with an opening 24. The opening 24 may also be located in the top wall 12 and a side wall 14 or in the top wall 12 and one or more side walls. The opening 24 may be covered by a plastic film covering (not shown), which has a slit formed therein (also not shown), wherein tissues 50 are dispensed in a pop-up manner through the slit. The opening 24 or the slit is small enough such that tissues 50 will be constricted from falling back through the opening 24 or slit after they have been pulled through the opening 24 or slit.

A plurality of tissues 50 are stacked inside the carton 10. Preferably, the tissues 50 are interfolded. There are a variety of ways of interfolding tissues, such as a Z-fold or a V-fold, which are well known in the art. Pop-up dispensing of the tissues 50 is possible due to the interfolding of tissues 50 and the constriction on the tissues 50 caused by the opening 24. In particular, due to interfolding of the tissues 50, when a first tissue is pulled up through the opening 24, a leading section of the tissue immediately beneath the first tissue, i.e., a second tissue, is pulled through the opening. Because of the constriction on the tissues 50 by the opening 24, once the leading section of the second tissue is outside the carton 10, this tissue will preferably not fall back through the opening 24. Thus, the leading section of the second tissue will remain outside of the carton 10, while the trailing section of the second tissue will remain inside of the carton 10, interfolded with a third tissue.

The above process is repeated when a person pulls the second tissue out of the carton 10. Because a third tissue is interfolded with the second tissue, a leading section of the third tissue will be pulled through the opening 24. Due to the constriction on the leading section of the third tissue by the opening 24, this tissue will preferably not fall back through the opening 24 but will instead remain outside of the carton 10 for the next use. This process may be repeated again and again until all of the tissues 50 have been dispensed from the carton 10.

Figure 2:
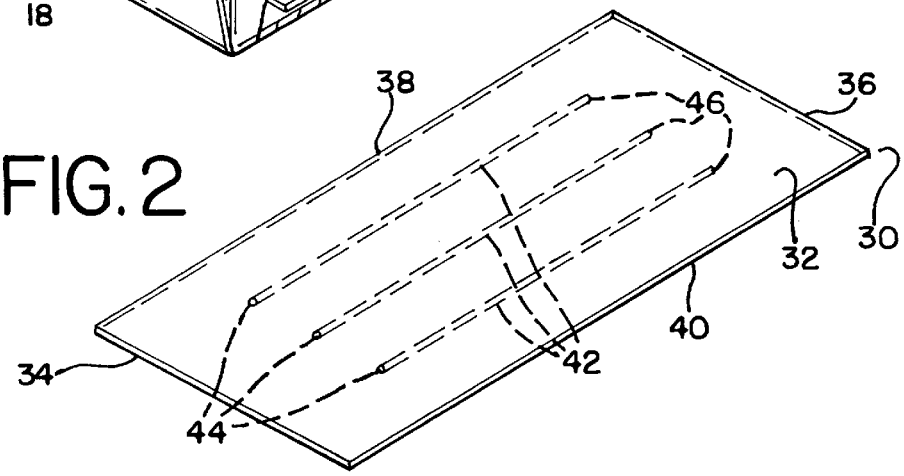
FIG. 2 is a perspective view of the clip lift of the present invention when the clip lift is in a flat position.
Figure 3:
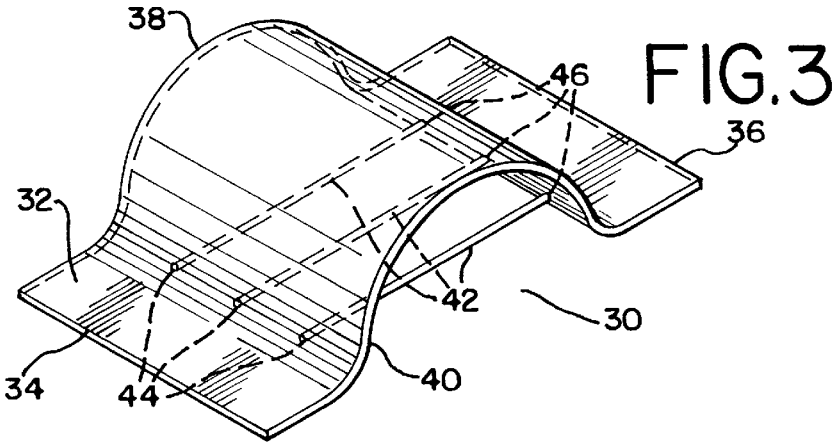
FIG. 3 is a perspective view of the clip lift of FIG. 2 when it buckles in an upward direction.

As shown in FIGS. 2 and 3, the clip lift 30 includes a bendable sheet of material 32 and one or more elastic members 42. The bendable sheet 32 has four edges 34, 36, 38, 40, preferably, for example, in a rectangular configuration. Edges 34 and 36 are opposite from one another, and edges 38 and 40 are opposite from one another. The dimension of the bendable sheet 32 is smaller than the carton 10. The elastic member 42 is attached to the bottom of the sheet 32 at ends 44, 46 of the elastic member 42. End 44 of the elastic member 42 is attached near one edge 34 and end 46 of the elastic member is attached near the edge 36 (which again is opposite from edge 34) of the bendable sheet 32. When the elastic member 42 is attached to the bendable sheet 32, it is stretched and is thus under tension.

The bendable sheet 32 may be any material that can be bent upwardly in an inverted V-shape or U-shape to push the stack of tissues 50 toward the top wall 12. For example, the bendable sheet 32 may be as shown, a bendable paper, or a plastic material. Alternatively, the bendable sheet may be two pieces joined by a hinge (not shown) to produce an inverted V-shape or U-shape as the elastic draws the two pieces together.

Figure 4:
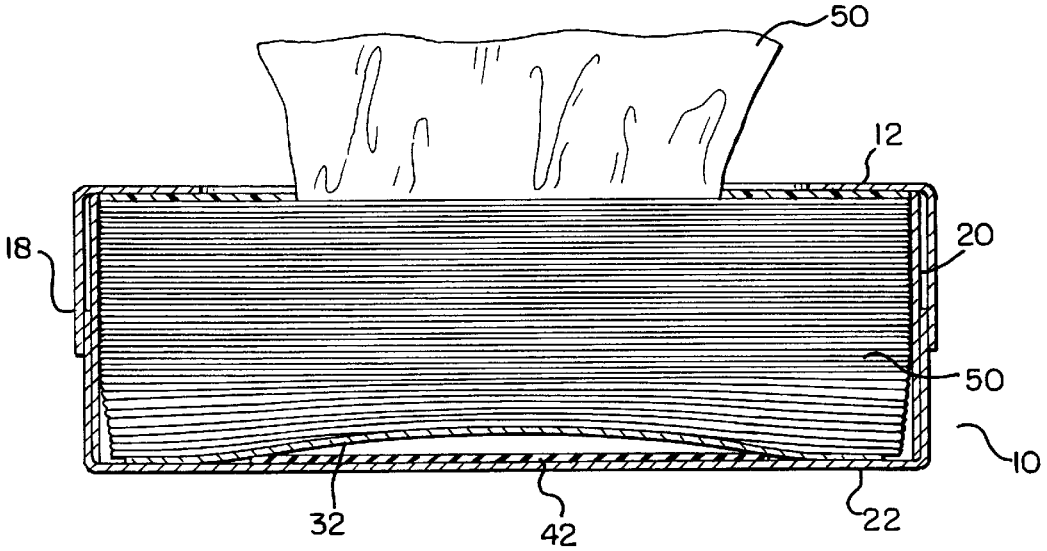
FIG. 4 is a cross-sectional view of a facial tissue dispensing system incorporating the clip lift of FIG. 2 when the clip lift is in a flat position.
Figure 5:
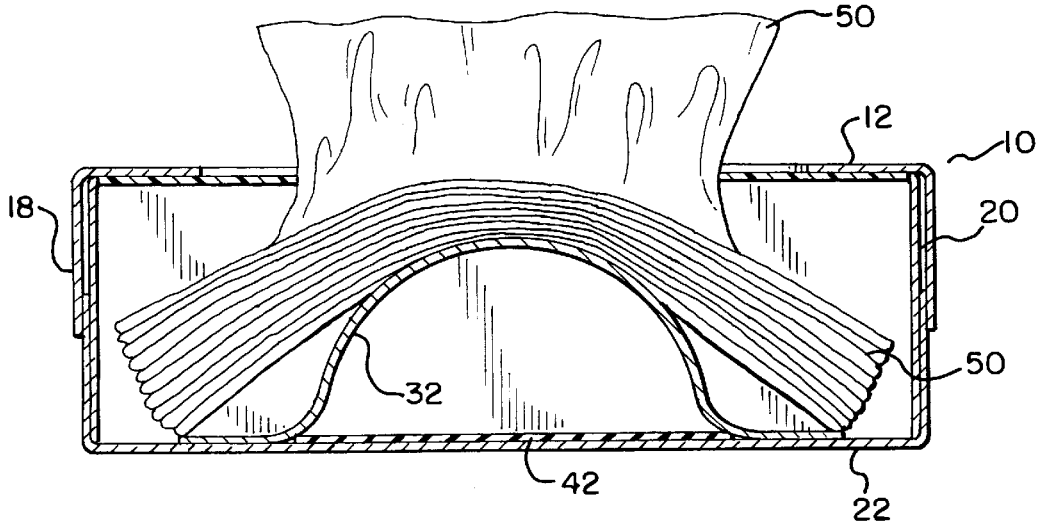
FIG. 5 is a cross-sectional view of a facial tissue dispensing system incorporating the clip lift of FIG. 2 when the clip lift buckles in an upward direction.

As shown in FIGS. 4 and 5, the clip lift 30 is positioned beneath the stack of facial tissues 50 placed in the carton 10. The clip lift 30 lifts the facial tissues 50 upward as the tissues 50 are being dispensed in the following manner. When the carton 10 is full with tissues 50, as shown in FIG. 4, the weight of the tissues 50 on the bendable sheet 32 holds the sheet 32 in a flat position. Once tissues 50 are dispensed from the carton 10 and the weight of the tissues 50 on the bendable sheet 32 diminishes, the elastic member 42 begins to relax or to experience a decrease in tension. Thus, the length of the elastic member 42 begins to decrease or, in other words, the elastic member 42 begins to contract. As shown in FIG. 5, the contraction in length of the elastic member 42 causes the bendable sheet 32 to buckle in an upward direction in its middle. Thus, the bendable sheet 32 begins to buckle in an upward direction in the shape of a bell-shaped curve. The buckling of the sheet 32 causes the facial tissues 50 also to buckle in an upward direction in their middle towards the top wall 12 of the carton 10. Thus, the facial tissues 50 are pushed in an upward direction toward the opening 24 in the top wall 12 through which the tissues 50 are dispensed.

The lifting force of the bendable sheet 32 on the facial tissues 50 may be optimized by varying the stiffness of the bendable sheet 32, as well as varying the number, size and pretension and position of attachment of the elastic members 42. For example, as illustrated in FIGS. 2 and 3, there are three elastic members 42. However, this invention is not limited to having three elastic members 42, but may have only one elastic member 42, two elastic members 42 or any number greater than three elastic members 42.

Additionally, in a preferred embodiment, each of the ends 44, 46 of the elastic member 42 is attached to the bendable sheet 32 at a distance (from the edges 34, 36) of ⅓ of the length of the bendable sheet 32. More particularly, end 44 is attached at a distance of ⅓ of the length of the bendable sheet 32 measured from the first edge 34 of bendable sheet 32. Similarly, end 46 is attached at a distance of ⅓ of the length of the bendable sheet 32 measured from the second edge 36 of the bendable sheet 32. Thus, the distance between the points of attachment of the ends 44, 46 is also ⅓ of the length of the bendable sheet 32. Thus, in this embodiment, the clip lift lifts the tissues 50 in their middle section. This invention, however, is not limited to such placement. The elastic members 42 may be attached at varying positions on bendable sheet 32.

The bendable sheet 32 upon which the tissues 50 are positioned upon may be made of any number of materials which may support the weight of the tissues 50 and which may be deformed in an upward direction. Thus, the bendable sheet 32 may be made of a material such as paper or cardboard. Cardboard is a good material because it is low in cost and is recyclable. The elastic member 42 may be made of any number of elastic members which may be stretched and which will cause the bendable sheet 32 to deform. In one embodiment, the elastic member is one or more rubber bands.

Of course, it should be understood that a wide range of changes and modifications can be made to the embodiments described above. It is therefore intended that the foregoing description illustrates rather than limits this invention, and that it is the following claims, including all equivalents, which define this invention.

What is claimed is:

1. A facial tissue dispensing system including a clip lift member comprising:

a rectangular carton, including top, bottom, end and side walls, a stack of interfolded tissue sheets disposed within said carton, said top wall having a removable section defining an opening for dispensing said tissue sheets, a clip lift member comprising at least one bendable sheet positioned beneath said stack of interfolded tissue sheets and above said bottom wall of said carton, said bendable sheet including a first edge portion, a second edge portion opposite said first edge portion and a bottom surface, and at least one elastic member, including a first end and a second end opposite said first end, said first end of said at least one elastic member being attached proximate said first edge portion of said bendable sheet on said bottom surface of said bendable sheet and said second end of said elastic member being attached proximate to said second edge portion of said bendable sheet on said bottom surface of said bendable sheet, wherein, as tissues sheets are dispensed from said carton and said elastic member relaxes in tension, said elastic member contracts in length and said bendable sheet bends, thereby causing said bendable sheet to rise in an upward direction toward said top wall of said carton to rise said stack of interfolded tissue sheets in an upward direction toward said opening in said top wall.

2. The facial tissue dispensing system including a clip lift member of claim 1 wherein said bendable sheet is a cardboard material.

3. The facial tissue dispensing system including a clip lift member of claim 1 wherein said elastic member is a rubber band.

4. The facial tissue dispensing system including a clip lift member of claim 1 wherein said elastic member is a plurality of elastic members.

5. The facial tissue dispensing system including a clip lift member of claim 4 wherein said plurality of elastic members are rubber bands.

6. A tissue dispensing system including a clip lift member comprising:

a carton comprising at least a pair of opposite walls, with one of said walls having an opening;

a stack of interfolded tissue sheets disposed within said carton;

a clip lift member comprising:

at least one flexible sheet positioned between said stack of interfolded tissue sheets and said wall opposite said wall having said opening, said flexible sheet including a bendable portion; and at least one elastic member attached to said flexible sheet at a first and second location, with said second location spaced apart from said first location and said at least one elastic member extending between said first and second location, said bendable portion of said flexible sheet extending at least between said first and second location;

wherein said bendable portion forms a bell-shaped curve as said elastic member relaxes in tension and contracts in length, said bell-shaped bendable portion extending toward said wall of said carton having said opening so as to bias said stack of interfolded tissue sheets toward said opening in said wall.

7. The dispensing system of claim 6 wherein said flexible sheet is a cardboard material.

8. The dispensing system of claim 6 comprising a plurality of elastic members.

9. The dispensing system of claim 6 wherein said elastic member is a rubber band.

* * * * *